United States Patent [19]

Chateau et al.

[11] 4,120,362

[45] Oct. 17, 1978

[54] SUBSEA STATION

[75] Inventors: Georges M. Chateau, Pau, France; Chester B. Falkner, Jr., Huntington Beach, Calif.

[73] Assignee: Societe Nationale Elf Aquitaine (Production), France

[21] Appl. No.: 743,586

[22] Filed: Nov. 22, 1976

[51] Int. Cl.[2] ..... E21B 33/035

[52] U.S. Cl. ..... 166/339; 175/7; 166/366; 166/362

[58] Field of Search ..... 166/0.5, 0.6; 175/7; 61/69 R

[56] References Cited

U.S. PATENT DOCUMENTS

| | | | |
|---|---|---|---|
| 3,633,667 | 1/1972 | Falkner | 166/0.5 |
| 3,777,812 | 12/1973 | Burkhardt et al. | 166/0.6 |
| 3,877,520 | 4/1975 | Putnam | 166/0.6 |
| 3,987,638 | 10/1976 | Burkhardt et al. | 166/0.5 X |
| 4,036,295 | 7/1977 | Kirkland et al. | 166/0.6 |

*Primary Examiner*—Ernest R. Purser
*Attorney, Agent, or Firm*—Poms, Smith, Lande & Glenny

[57] ABSTRACT

A subsea station or installation in which one or more rigid elongated base template frames are adapted to be permanently positioned on a sea floor. Each base template frame includes a plurality of framed receptor openings, each adapted to receive a module guide base for aligning and releasably connecting thereto module unitary assemblies, each of which carries selected equipment in a protected manner. Extending along each side of the base frame are elongated side structures releasably connected to the base frame and recoverable for maintenance and service, each side structure extending outboardly of the sides of the base frame and being adapted to carry fluid conducting lines, power lines, and a rail means for guidance of a submarine capsule along the length of the base frame. Flowlines for conducting fluid to a remote platform or onshore installation are connected to the fluid conducting lines on the side structures by means of a transversely disposed pipe loop means supported from the base frame and arranged to compensate for expansion and contraction of the flowlines and pipelines and to provide yieldability in the makeup connections of flowlines to the pipe loop means. The rigid base frame includes guide and support members for power control means such as electrical and hydraulic actuating means for operation of the equipment carried by the modular assemblies and by the rigid base frame. A method of lowering a rigid base template frame from a work boat and assisted by a drill ship and controlling selected orientation of the base frame to and in a selected position on the sea floor.

16 Claims, 19 Drawing Figures

SUBSEA STATION

BACKGROUND OF THE INVENTION

Subsea stations and installations have been contemplated for use in water depths beyond convenient diver working depths. Such subsea stations have been installed, maintained and operated by automatic, remote systems. Such prior subsea installations have been designed for single and multiple well requirements.

In subsea installations below depths at which divers may readily operate, installation, maintenance and operation of such installations, was accomplished by automatic, remote control means, remotely controlled robot devices, or by submarine devices. In many such prior subsea installations, connections of flowlines, power lines and various types of equipment usually required some relative horizontal movement of connector parts. Such relative horizontal movement of parts by remote control was often difficult because of the need for precise alignment, registration or orientation in a horizontal mode. Further, such prior subsea installations were inadequately protected from the hostile environment of the sea water, inadequately protected from subsea currents and movement of foreign matter by such currents. Maintenance and repair of a part of the installation often required shutdown of operating systems which were not directly associated with the part being repaired.

Solutions to some of the problems mentioned above are suggested by U.S. Pat. No. 3,633,667 which shows a multiple wellhead template provided with a wellhead unit and a production control unit, which were recoverable as units for maintenance and service. A subsea robot device movable about a wellhead on a rail is shown in U.S. Pat. No. 3,099,316.

SUMMARY OF THE INVENTION

This invention relates to a subsea station or installation which may be readily located on a sea floor and which includes a permanent base means upon which a plurality of recoverable subsea station units or assemblies are releasably connected to permit maintenance and service thereof. The invention particularly relates to a novel arrangement of a permanent, rigid base template frame means and a plurality of unitary assemblies associated therewith wherein installation of such unitary assemblies are provided in a vertical mode and wherein interconnections made in a horizontal mode are eliminated or reduced to a minimum.

The invention particularly contemplates a subsea station having a construction and operation which permits use of the station for many purposes including, primarily, use in connection with the drilling, production and workover of subsea wells. The invention contemplates such an installation in which observation of the surrounding environment may be provided as in oceanography, commercial fishing, environmental protection, military and meteorological applications, and other types of marine and submarine industrial applications.

The invention also contemplates a novel method for lowering and positioning a rigid template base frame means on the sea floor.

The primary object of the present invention is to provide a novel construction and operation of a subsea station or installation, including a novel method of commencing installation of such a station.

An object of the invention is to provide a novel construction and arrangement of a subsea station wherein assembly of various parts of the subsea station with a rigid base means is facilitated by a system of vertical guidance means.

Another object of the present invention is to provide a subsea installation, which may be readily assembled on the sea bottom with automatic, remotely controlled means.

A further object of the present invention is to provide a subsea station having prefabricated, preassembled modules for supporting equipment and protecting such equipment during operation in a hostile environment.

A more specific object of the invention is to provide unitary, modular assemblies of novel structure in which equipment carried thereby is protected and shielded, in which the modular module assembly includes guiding devices for association of other equipment therewith, and in which the modular assembly is readily alignable with its supporting structure and readily releasable for maintenance and service thereof.

A further specific object of the invention is to provide a subsea installation including an elongated, rectangular, permanent, rigid base means providing a plurality of receptor openings adapted to receive modular assemblies, said base means being also adapted to receive elongated side structures releasably connected to the base means and affording protection for modular assemblies and for fluid conducting lines carried thereby.

A still further object of the present invention is to provide a pipe loop means for interconnecting flowlines to remote installations to fluid conducting lines on the subsea installation wherein the pipe loop means readily compensates for differences in expansion and contraction of the fluid conducting lines and flowlines connected therewith.

A further object of the invention is to provide a subsea installation, which is protected against corrosive effects of the sea water.

Various other objects and advantages of the present invention will be readily apparent from the following description of the drawings in which an exemplary embodiment of the invention is shown.

IN THE DRAWINGS

Figures 1, 2:
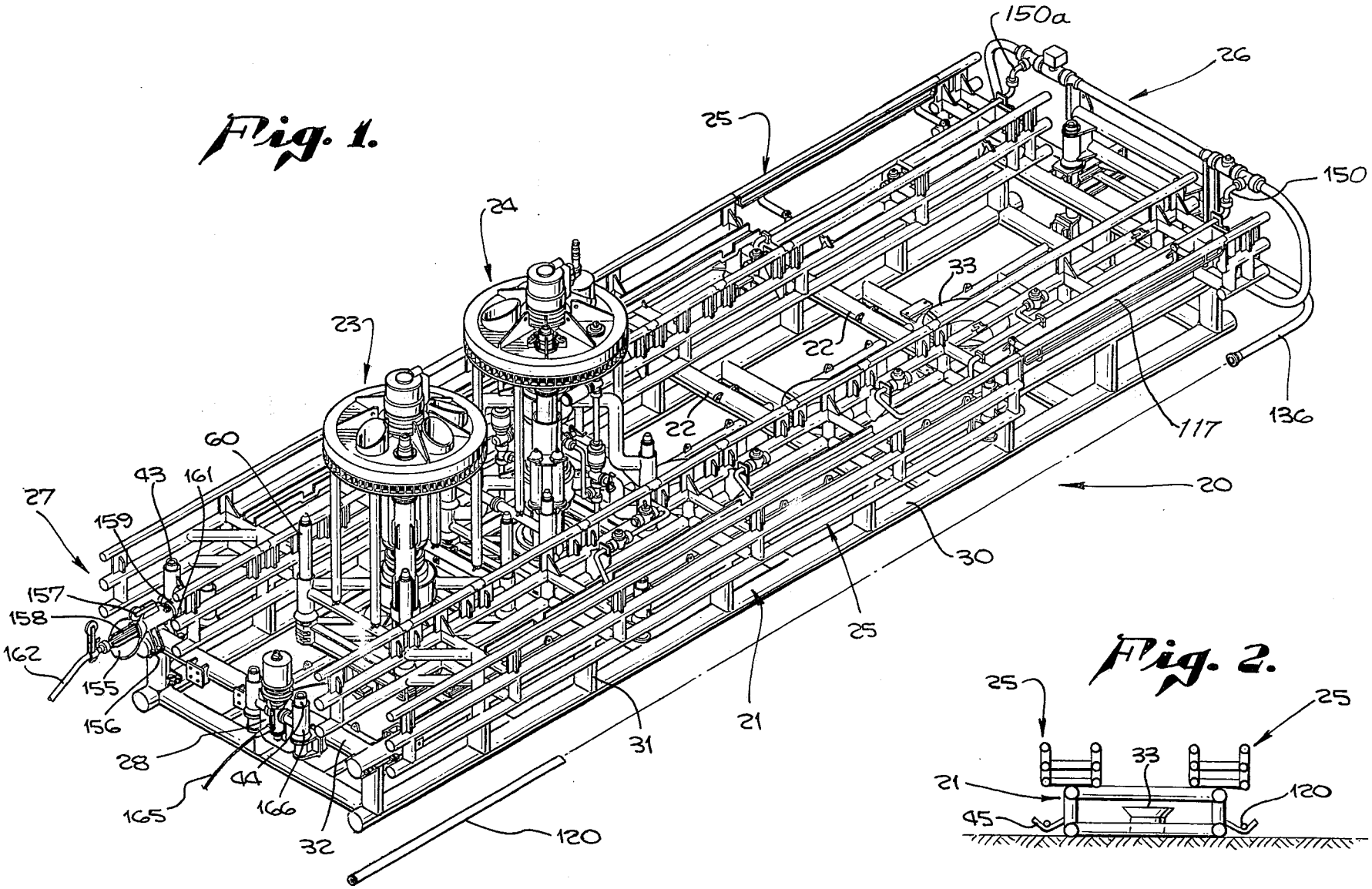
FIG. 1 is a perspective view of a subsea station or installation embodying this invention, the station and recoverable modules assembled therewith being drawn in detail.
FIG. 2 is a schematic, transverse, sectional view taken in a vertical plane showing the arrangement of the rigid base means and a pair of side structures thereon.

In FIG. 1, a subsea station or installation embodying this invention is generally indicated at 20. Subsea installation 20, generally speaking, comprises a rigid template base means 21 having a plurality of framed receptor openings 22. In alignment and in registration with one or more of the receptor openings 22 are recoverable unitary module assemblies 23 and 24, which are releasably connected to base frame means 21 and which may carry equipment particularly selected and adapted for the intended purpose and use of the subsea installation. In this example, the subsea installation is shown used for the production and handling of liquid hydrocarbons obtained from one or more subsea wells. As later described, the module assemblies may be provided with equipment for other uses and purposes.

An elongated, recoverable, side structure 25 is releasably mounted on each longitudinal side of base means 21 and on opposite sides of the module assemblies 23, 24. The elongated side structure 25 carries suitable power lines, fluid conducting lines, and a rail means. Power and fluid conducting lines on each side structure 25 may be releasably connected with associated lines on modular assemblies 23, 24 for operation thereof, as later described. At one end of base means 21, a transversely disposed pipe loop means 26 interconnects adjacent ends of the side structures 25 and may be releasably supported on the base means. At the opposite end of base means 21, a flowline connector means 27 is provided for connection with suitable fluid conducting lines on the associated side structure 25. At the same end of base means 21, an electrical power connecting means 28 is provided for supplying electrical power to the modular assemblies and to other power operated equipment on the installation 20. The power source may be remotely located on a ship, vessel platform or on shore. The power source may also be a nuclear or other self-contained power source adapted to be carried by the subsea station. The installation 20, generally described above, provides a complete operable installation intended to be permanent but includes unitary assemblies, each of which is recoverable, without interrupting operation of other units, for inspection and maintenance or for dismantling of the installation, except for the base means 21.

Figure 3:
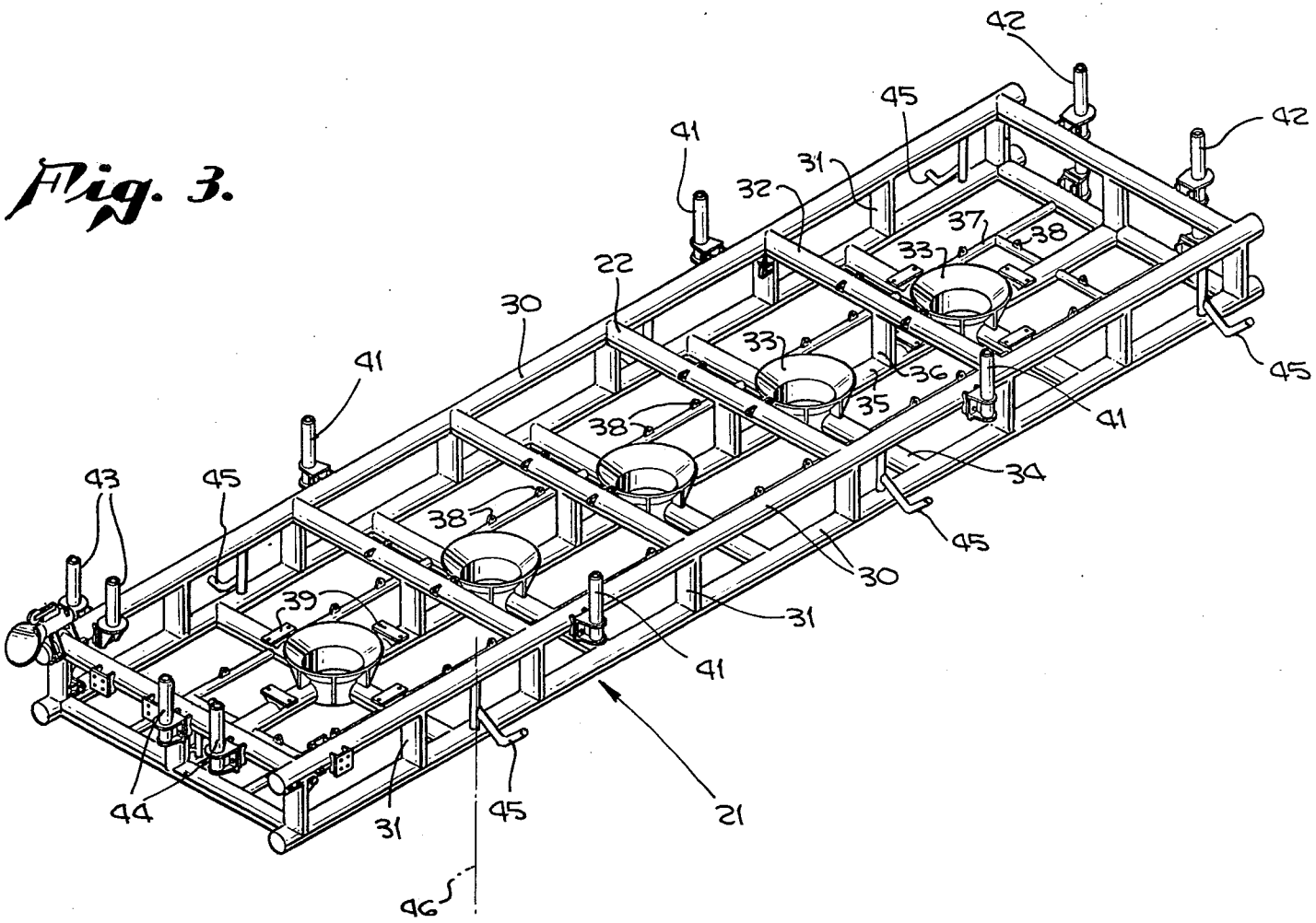
FIG. 3 is a perspective view of the rigid base assembly shown in FIG. 1.

The rigid base means 21 (FIG. 3) comprises an elongated, rectangular, rigid structure of suitable length and width. In this example, base means 21 includes vertically spaced parallel side frame tubular members 30, the side members 30 along each side being interconnected by spaced vertical struts 31. Top members 30 are interconnected by transversely extending tubular members 32, which define with the top side members 30, the receptor openings 22. In this example, each receptor opening 22 includes a conductor pipe 33 rigidly connected to the frame members 30 by transverse tubular elements 34 and rigidly connected to the transverse members 32 by central longitudinally extending members 35 connected to transverse members 32 by vertical struts 36. The base frame means 21 may also include longitudinally extending parallel tubular members 37 interconnecting transverse members 34, said members 37 being provided with longitudinally spaced cleats or eyelets 38, so arranged with respect to each receptor opening 22 as to provide means for connecting a plurality of guide lines depending from a support vessel. Also, the transverse members 34 and the longitudinally extending member 35 may be provided with support and securing pads 39 for attachment of equipment as later described.

Top side members 30 carry outboardly disposed longitudinally spaced removable guide posts 41 attached to members 30 in suitable manner and providing vertical guidance means for the side structures 25 as hereafter described. At one end of the base means 21, vertically disposed guide posts 42 provide a guidance means for connection of the pipe loop means 26. At the opposite end of the base means 21, vertical guide posts 43 may be provided adjacent one corner for cooperable guidance of flowline connector means as later described. At the same end, vertical guide posts 44 may be provided for guidance of an electrical connector means, as later described.

Along each side of base means 21 and mounted about a vertical pivotal axis at 46 are a plurality of spaced flowline support arms 45 of generally V-shape for supporting a flowline alongside the base means 21. During installation, each support arm 45 may be pivoted about its pivotal axis 46 to lie generally within the plane of the top and bottom side tubular members 30. The arms 45 may be rotated through 90° to extend outboardly from the base means after the base means has been positioned on the seabed.

Other support pads, vertically disposed guide posts and eyelets or cleats may be secured to the base means to accommodate other equipment. The rigid base means 21 may be made of any suitable structural members, tubular members being preferred because of their strength, buoyancy characteristics, and their possible use as ballast means, if desired. The surfaces of the tubular members may be treated with corrosive resistant material and by sacrificial anodes.

Conductor pipes 33 centrally located with respect to the receptor openings 22 provide an upwardly and outwardly flaring seating surface, which may be used for centering and guiding of a modular unit in the opening, used for drilling a well hole therethrough, and are so arranged to permit modular units or other equipment installed in the receptor opening to be vertically disposed in the event the sea bottom is at a slightly inclined angle.

Figure 4:
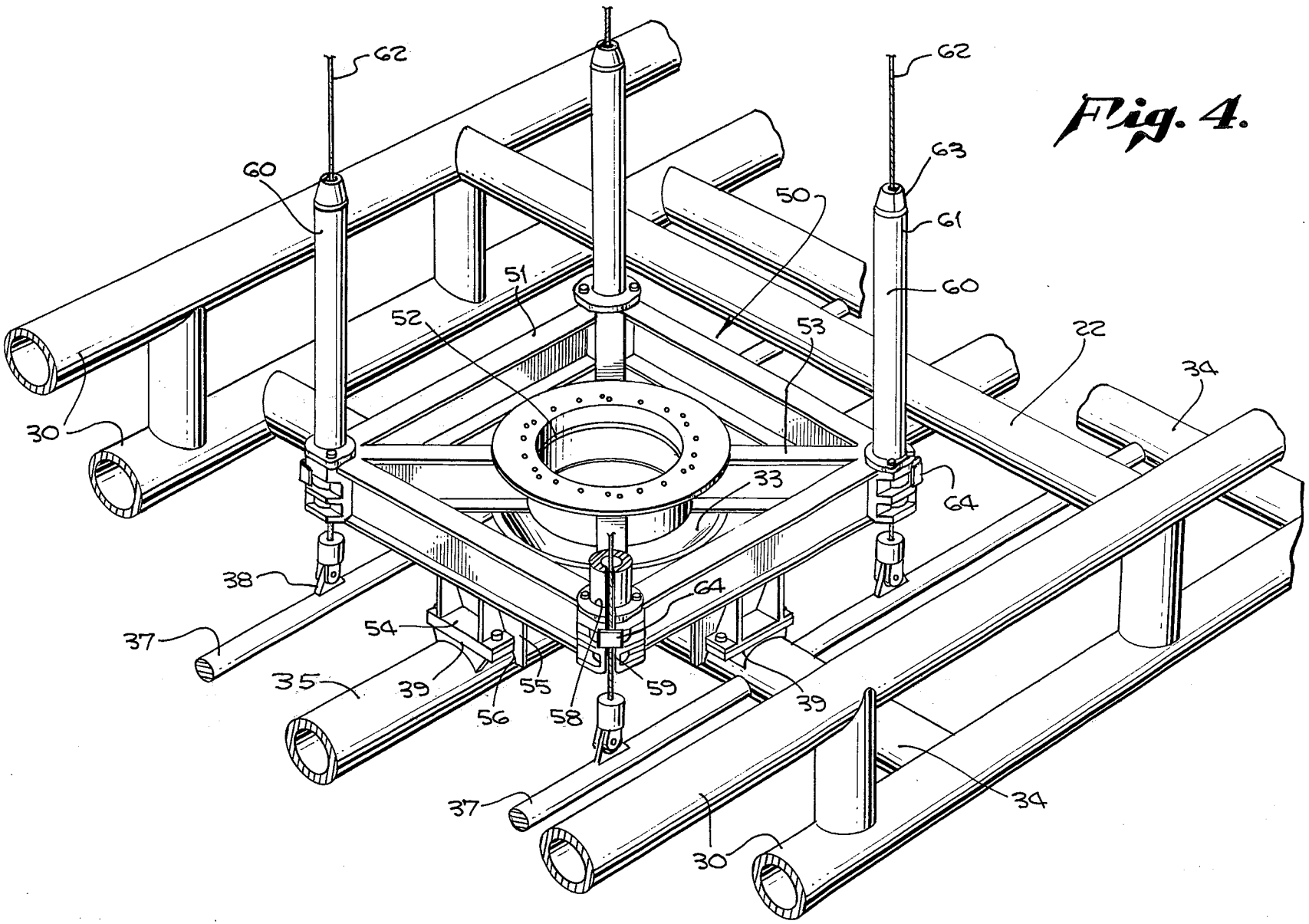
FIG. 4 is an enlarged, fragmentary, perspective view of one of the receptor openings within which is positioned a module base means.

For each opening 22, which is to receive a modular assembly such as 23, 24, there is provided a base guide means 50, FIG. 4. Each base guide means 50 includes a generally square or polygonal frame 51 formed of structural sections, such as I-section and having a centrally supported flanged cylindrical member 52 for coaxial alignment with conductor pipe 33. Cylindrical member 52 is supported by diagonal, structural elements 53. Depending from each frame member 51 are support plates 54 adapted for cooperable seating connection to securement pads 39 on base means 21. Support plates 54 may be welded to a back plate 55 which includes a downwardly opening yoke 56 forming an opening for reception of tubular members 34 and 35.

Base guide means 50 also includes, at each corner, means forming a cylindrical thru bore means 58 having a vertically disposed through slot 59 facing diagonally outwardly from the base guide means. Bore 58 receives the lower end of a guide post 60 provided with a longitudinally extending slot 61 which is alignable with the slot 59 of the cylindrical bore means 58. The guide post 60 is adapted to receive therethrough a guide line 62 which may be secured to a cleat 38 on tubular member 37. The guide line 62 may be retained within the guide post 60 by a top slot closure element 63 and by a suitable slot closing means 64 on the corner cylindrical bore means 58.

Thus, the base guide means 50 may be lowered along four guide lines into proper alignment and registration with the receptor opening and with the conductor pipe 33 therein. The guide lines may be released upon disconnection from the cleats on the tubular members, opening of the slot closure elements 63 on the guide posts and then moving the guide lines laterally through the vertical slots 69 and 61 to release the lines from the base guide means 50.

It will be understood that in some instances the base guide means 50 may be secured in the receptor opening before the base means 21 is lowered to its position on the sea floor. The construction of the base guide means 50, as described above, permits the lowering and connection of the base guide means to base means 21 in the event it is desired to occupy another receptor opening 22 with another type of modular assembly.

Modular assemblies 23 and 24 are preassembled and fabricated on shore to perform desired functions; in this example, modular assembly 23 (single module) may include the necessary equipment for a production control unit and modular assembly 24 (dual module) may include equipment for a well-head assembly. Since each modular assembly includes common structural elements and the equipment associated with each assembly may be different because of the different uses and functions of the modular assembly, for brevity the structure of only one of the modular assemblies will be described in detail.

Figure 5:
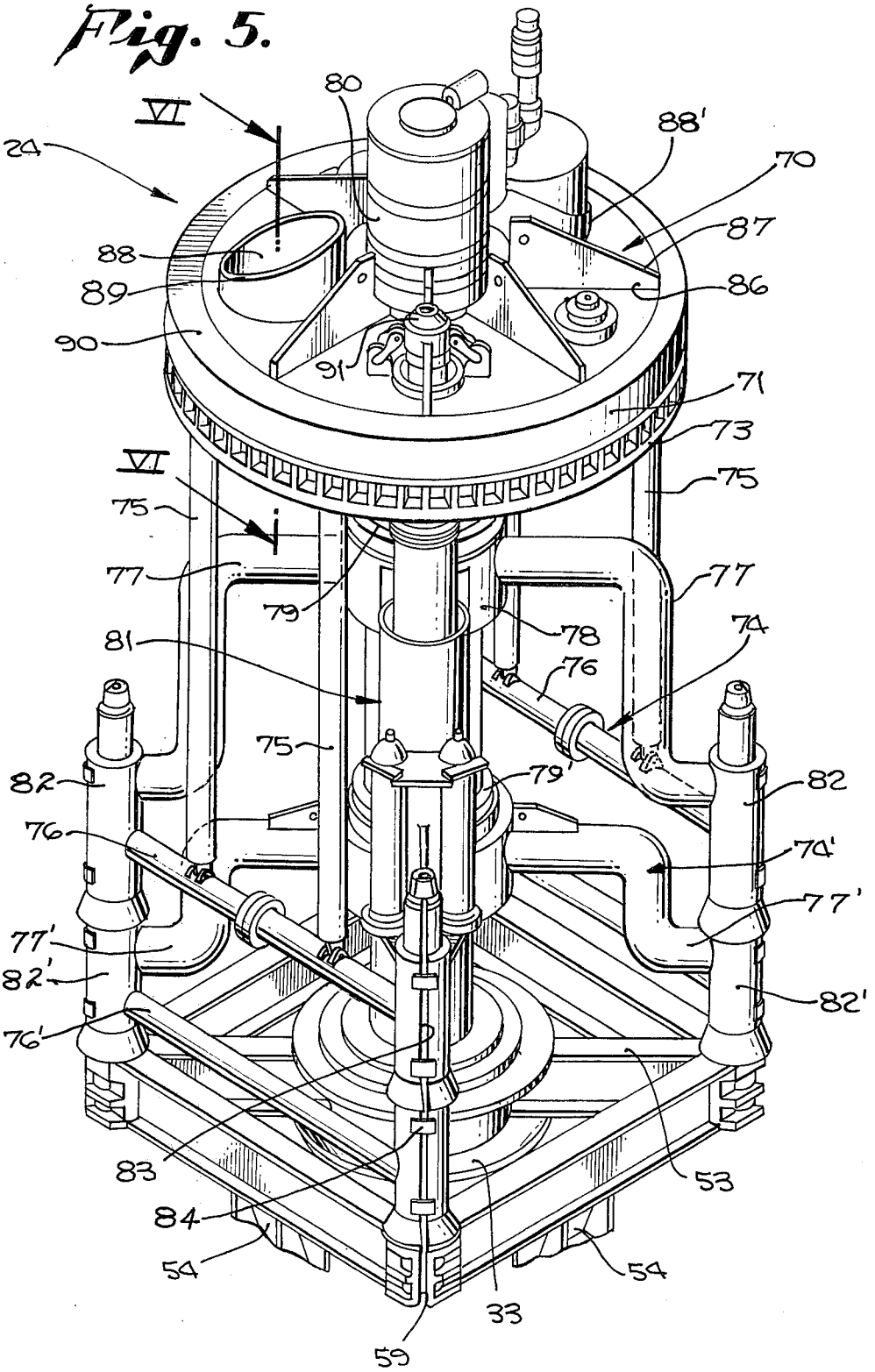
FIG. 5 is an enlarged, perspective view of an exemplary modular assembly shown in FIG. 1.
Figures 6, 7:
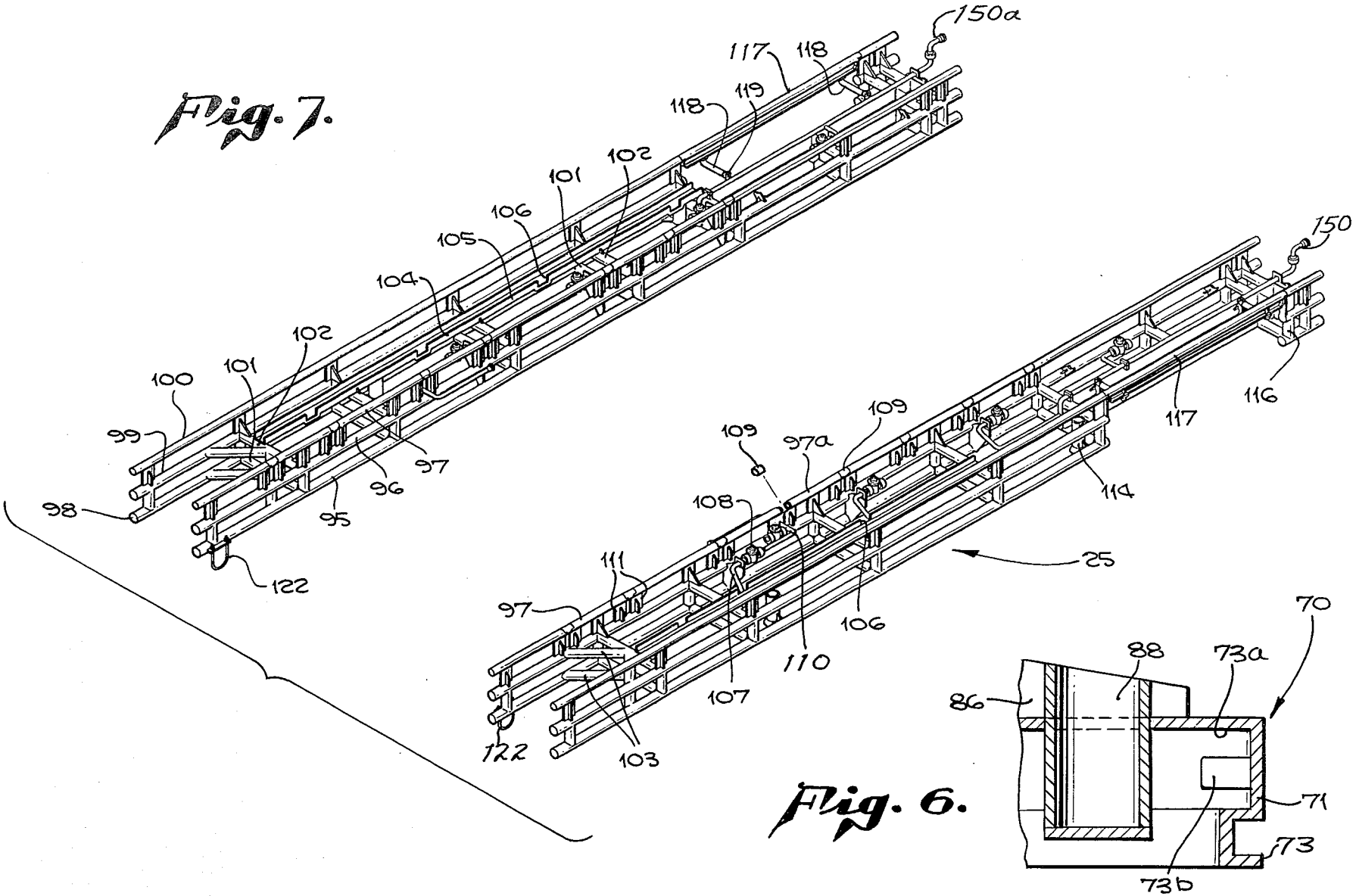
FIG. 6 is a fragmentary, transverse, sectional view taken in a radial plane indicated by the line VI — VI of FIG. 5.
FIG. 7 is a perspective view of a pair of side structures shown in FIGS. 1 and 2.

Modular assembly 24, FIGS. 1, 5 and 6 may comprise a top circular wall means 70 having a depending peripheral flange 71 provided with a plurality of circumferentially spaced reinforcement ribs supporting a bottom annular horizontal flange 73. A downwardly facing recess **73*a* is provided by top wall 70 and depending flange 71 for the collection of lighter than water pollutants, such pollutants collecting beneath the top wall 70 and being detected by suitable sensing means 73*b***. After detection of such pollutants, suitable means may be actuated for removing the pollutants.

Below top wall 70 is provided a modular base 74. A plurality of peripherally spaced columns 75 are connected to the module base 74 and top wall means 70 by suitable connecting means. Columns 75 provide an open cage adapted to protect equipment within the cage from damage by debris or objects moving across the sea floor.

Module base 74, in this example, includes side tubular base members 76 and upwardly offset diagonal members 77 interconnected at vertical guide sleeves 82 and supporting a two part cylindrical housing 78 for axially positioning connector means 79 or other equipment along the axis of the base guide means 50 and conductor pipe 33 on the base means 21. Extending between the top wall means 70 and the module base 74 and connected to the connector means 79 may be other suitable equipment arranged in axial alignment and providing a central structural core generally indicated at 81, rigidly supporting and interconnecting top wall 70 with base 74. A mandrel means 80 axially extends above top wall 70 for connection with equipment which is lowered for association with the modular assembly 24 and is shown with protection closure means thereon.

Guidance means for the modular assembly 24 is provided by a vertically disposed cylindrical sleeve 82 provided at each end of base frame members 76 and dimensionally arranged to be guided over and to receive guide posts 60 provided on a second part 74' carrying safety mechanical tree equipment for association with the well and with production equipment thereabove on module part 74 which may be automatically or remotely controlled. Each sleeve 82 has a longitudinally extending slot 83 closed by suitable gate means 84 for facilitating insertion and removal of installing guide lines.

Modular part 74' comprises frame member 76' interconnected at their ends with diagonal offset members 77' and with vertical guide sleeves 82' which receive guide posts 60. Diagonal members 77' carry connecting means 79' forming part of the rigid core 81. Modular part 74' provides a connection to the module base means 50 and permits the upper module part 74 carrying automatic and remote control equipment to be recoverable as a separate module part.

Modular assembly 24 also includes guidance means for equipment being received vertically above the modular assembly. In this example, top wall means 70 is provided with triangular shaped, upstanding angularly spaced gusset walls 86 having downwardly and radially outwardly inclined edges 87 to provide conical guiding surfaces. Similarly, cylindrical top members 88 provided between certain of the gusset members 86 are provided with top edges 89 lying in a transverse plane inclined downwardly and outwardly from the center of the top wall at approximately the same angle as the inclined edges 87 of the plates 86. Thus, devices being lowered for assembly with the modular assembly 24 at the top wall means 70 and provided with a conical funnel corresponding to the cone indicated by inclined edges 87 will be readily guided into coaxial alignment with the modular assembly.

Modular assembly 24 also includes on the top wall 70 a further guidance means, which includes a retractable vertically disposed guide post 91 which facilitates guidance of a device onto the modular assembly 24 by use of a single guideline as described and claimed in co-pending application Serial No. 759,032 owned by a common assignee.

Initially, the modular assembly 24 is readily guided into position by four guidelines which are connected to the rigid base means 21 and which extend through the guide base means 50 and through the cylindrical guide members 82, 82' on the modular base means 74, 74'. As seen in FIG. 1, the guidelines pass outside of the circumference of top wall means 70. The structure which forms the central post or core 81 of the modular assembly and the top wall means 70 provides means for supporting selected mechanical, hydraulic, electrical or other equipment within sealed housings supported beneath the top wall or associated with the central core member. The equipment assembly below top wall means 70 is arranged so that none of the equipment protrudes beyond the cylinder formed by the circular flange 71, nor beyond columns 75.

It will be understood that a modular assembly for use as a wellhead would be suitably equipped and may include a female drilling connector supported by the modular base 74' for cooperation with a male member carried by the base frame means 21, a plurality of housing for hydraulic, electrical and electronic units clustered beneath the top wall 70, a top cylindrical member 88 for reception of a sub-module, a plurality of accumulators for pressure fluid clustered around the core or central post member of the modular assembly, and various other tools and instruments adapted for mechanical, automatic, or remote operation. A top cylindrical member 88' may receive a sub-module adapted to provide electrical and hydraulic control connections.

It should be noted that top wall means 70 includes an upwardly facing annular planar surface 90 outwardly of guide gusset plates 86. Annular surface 90 is adapted to provide a seat for a subsea vehicle or capsule vertically guided onto the module assembly 24. Such a capsule has an annular seal member for making a water-tight, air-tight seal with the surface 90. The capsule may include robot equipment to work on equipment carried by the module 24 through a cylindrical member 88. The capsule may be a pressurized vehicle enabling men to perform maintenance, inspection, and service on the module 24.

Another modular assembly may be similarly equipped as a central control unit for one or more modular assemblies associated with the base frame means 21. Such a control modular assembly may receive electrical power from a remote source and be equipped to provide suitable power circuits of desired alternating current and direct current systems, a hydraulic power generating system with electrical power units, accumulators, reserve tanks, and distribution system, and devices for receiving control signals and transmitting such signals to the related equipment.

Elongate side structures 25, FIG. 7, are each a self-supporting, preassembled, removable unit which includes the necessary equipment for operably connecting with the module assemblies 23, 24; fluid conducting lines; power cables; a rail system for a subsea vehicle; and connecting means for the transverse pipe loop structure. Preferably, each elongate side structure is made of tubular members which may be provided with means for ballasting the tubular members, if desired.

Each side structure 25 includes a plurality of vertically spaced, parallel, inboard members 95, 96 and 97 and similarly arranged transversely spaced therefrom parallel, vertically spaced, outboard side members 98, 99 and 100. Outboard and inboard members are interconnected by a plurality of transversely extending members 101 and 102 and diagonal bracing members 103 where necessary. The top inboard and outboard members 97, 100 define with the transverse members 102, a longitudinally extending channel within which is received and supported an upwardly facing channel member 104. Channels 104 include along their inboard wall 105 openings 106 in spaced relation and positioned opposite a receptor opening 22 to permit the bending of a conduit or electrical line towards a module or other equipment positioned in the receptor opening 22. In the example shown in FIG. 7, such an opening 106 may receive therethrough a transversely extending portion of a fluid control line 107 which may be equipped with suitable valve means 108 for connection to one of the module assemblies. The fluid line 107 is capable of being turned about its longitudinal axis which lies parallel to the channel 104 to permit convenient positioning of the transverse or laterally extending portion 107 of the line. To further facilitate connection of the fluid conducting line 107 with a module assembly, the top inboard tubular member 97 may be provided with a plurality of aligned sections **97*a* at the ends of which are provided weight supporting plugs or bridging gates 109. Each gate may include a cylinder having steel end cores, the adjacent sections 97*a* and cylinders having "horizontal lap joints". Such gates may be removed so that the line 107 may be bent and passed therethrough as indicated at 110. It will be noted that each end of a section 97*a* is supported by vertical struts 111 and that the gate 109 provides access to the space between adjacent struts 111 of adjacent sections 97*a***.

Along the outboard members 98, 99 and 100 and in spaced, longitudinal relation may be provided vertical guide sockets 114 which cooperate with guide posts 41 provided on the base frame means 21. The side structure 25 (FIG. 2) has a suitable width such that when assembled with the base means 21 the outer side frame tubular members 98, 99 and 100 will extend beyond the side members 30 of base frame means 21. Thus, the side structures 25 provide protection for the rigid base frame means 21. Since the side structures 25 are removable from the rigid base means 21, in the event of severe damage to the side structures 25, they may be raised to the surface for repairs and then reassembled with the rigid base frame means 21.

At one end of each side structure 25, the outboard side tubular members 98 and 99 may be ended in spaced relation to stub sections of said members at the very end of the side structures to provide an opening 116. The topmost outboard side member 100 is provided with a section 117 above said opening, the section 117 being carried by a pair of spaced support arms 118 having a pivotally mounted connection at 119 to a central frame member of the side structure. The hinged arm support for the section 117 permits the section to be swung upwardly and away from the line of the external flowline 120, FIG. 1. The opening 116 and the hinging of the side member section 117 upwardly facilitates the making of a connection of a seabed flowline to the subsea installation as later described.

The side structures 25 may also be provided with securement means in the form of U-bolts 122 for securement of the end of side structure 25 to a transverse member 32 on the rigid base frame means 21.

Figure 8:
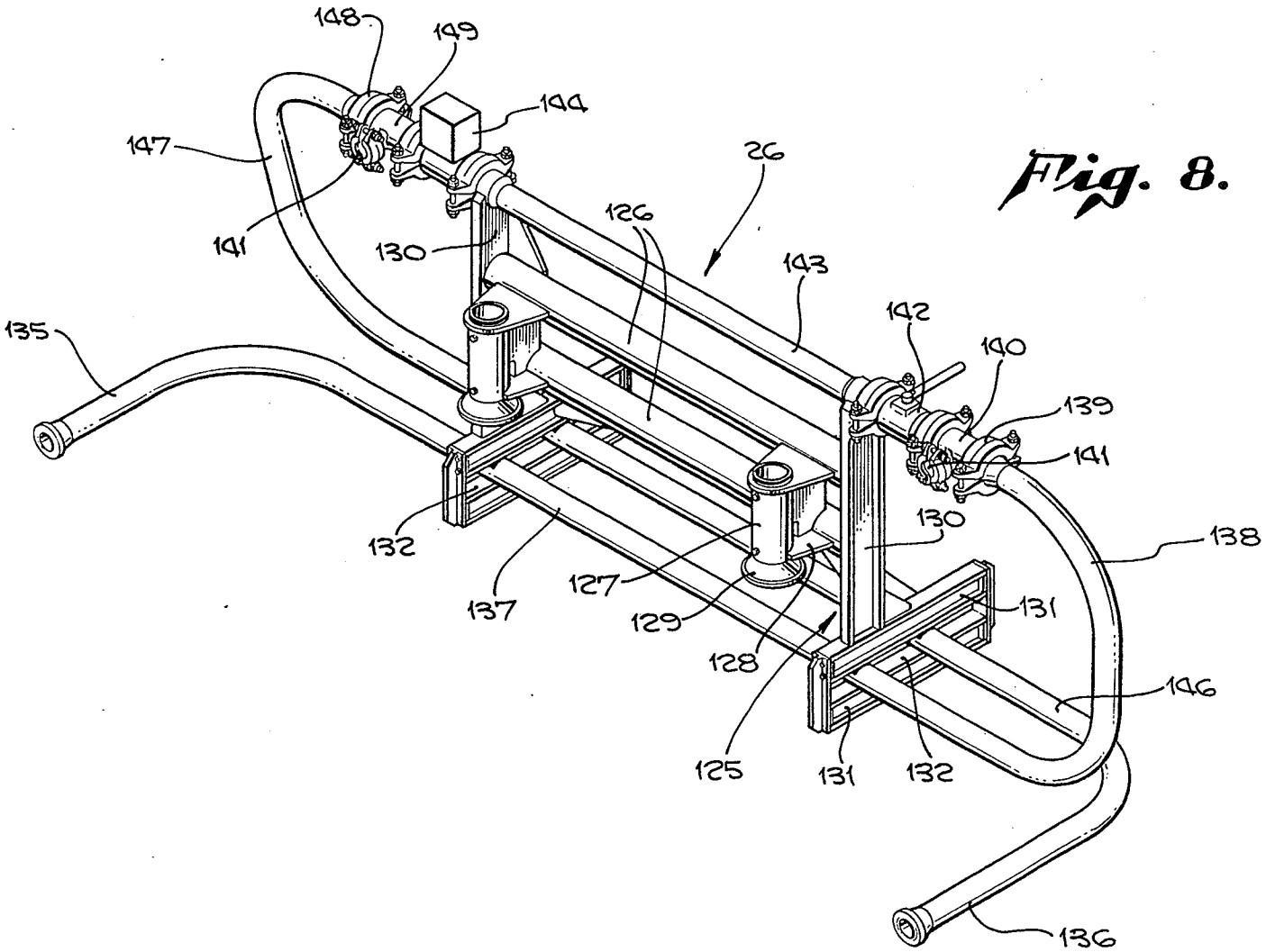
FIG. 8 is an enlarged, perspective view of a pipe loop means shown at one end of the station shown in FIG. 1.

At the end of the subsea installation at which the openings 116 are provided in the side structures 25, there may be provided a pipe loop means 26 which extends laterally or transversely across one end of the rigid base frame means 21. The pipe loop means 26 provides a means for connecting fluid conducting lines on the side structures 25 to flowlines on the seabed through a three-dimensionally expandable and contractible pipe loop arrangement. In FIG. 8, loop means 26 comprises a support frame 125 including a pair of vertically spaced, parallel, transverse, tubular members 126, which carry at adjacent opposite ends a cylindrical socket 127 supported by brackets 128 and having a downwardly, outwardly flaring cone 129 for guidance reception of the upstanding vertical guide posts 42 on the rigid base means 21. The frame 125 also includes spaced upstanding channel members 130 connected at their bottom ends to a pair of vertically spaced longitudinally extending members 131, which define therebetween a longitudinally extending guide slot 132.

Pipe loop means 26 includes a fluid conducting pipe 135 adapted to be connected to a seabed flowline on one side of the rigid base frame means 21 and a pipe 136 adapted to be connected to a seabed flowline on the opposite side of the seabed installation. Pipe 135 is bent to provide a transversely extending portion 137 which lies in approximately the same plane as the end of pipe 135 at its connection to the flowline and which passes through the guide slots 132. At the opposite side of the seabed installation, the pipe portion 137 is bent upwardly in a vertical plane to provide a generally U portion 138, which may be connected by suitable coupling means 139 to a T fitting 140, which provides fluid communication through an automatic connector 141 to a fluid conducting line 150 on the side structure 25. At the other end of the T fitting 140, there may be provided a manually operable valve 142 which may be connected to a transversely extending pipe portion 143 which extends between the vertical members 130 and may be connected to a motor driven remotely actuated valve 144 at the opposite side of the pipe loop 26.

The pipe 136 follows a similar configuration in forming the pipe loop means 26. Pipe 136 may be bent to provide a transverse portion 146 which extends transversely through the guide slots 132 and then is bent upwardly to provide a U portion 147 lying in a vertical plane and which has a suitable connection 148 to a T fitting 149 to provide connection through an automatic connector 141 to a fluid conducting line 150*a*, FIG. 1, carried by the side structure 25.

In the arrangement of the pipe loops 135, 137, 138 and 136, 146 and 147, it will be readily apparent that expansion and contraction of the pipe will be accommodated in a three-dimensional direction; that is, laterally, vertically and longitudinally relative to the end of the subsea installation. It will be understood that the fluid conducted in the pipes 135 and 136 may be of quite different characteristics. For example, fluid conducted in pipe 135 may be a hydrocarbon fluid being pumped under high pressure and at a certain temperature. Fluid conducted in pipe 136 may be a gas and may be of a quite different temperature. Thus, the pipe loop means 26 provides a unique, symmetrical construction for handling fluids of different characteristics and for providing three-dimensional yieldability to compensate for expansion and contraction of the pipe.

Figure 9:
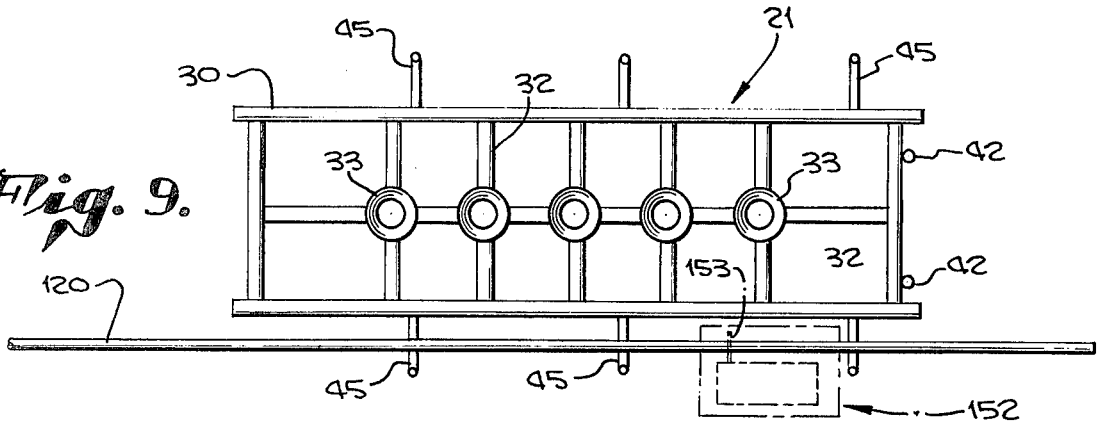
FIG. 9 is a top plan view schematically illustrating the connection of a seabed flowline to the pipe loop means on the subsea station shown in FIG. 1, the flowline being shown as extending beyond the subsea station and a remotely operated pipe connecting device being indicated in phantom lines.
Figure 10:
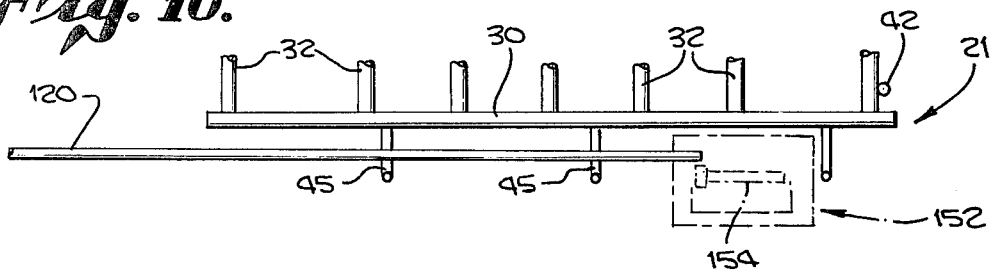
FIG. 10 is a fragmentary, schematic view of FIG. 9 showing the pipe cutting device and the seabed flowline after it has been cut at a selected point.
Figure 11:
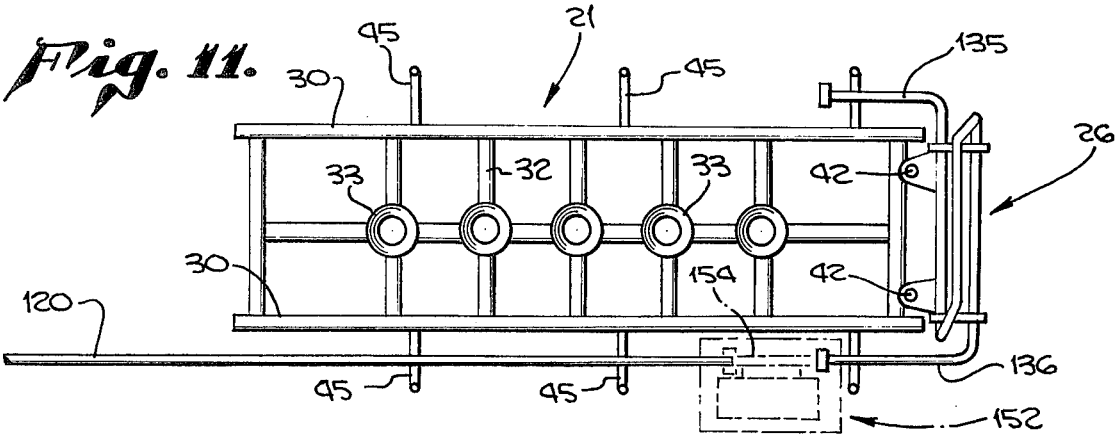
FIG. 11 is a schematic view showing the pipe cutting device installing a precut pipe length to connect the end of the seabed flowline and the free end of the pipe loop means.
Figure 12:
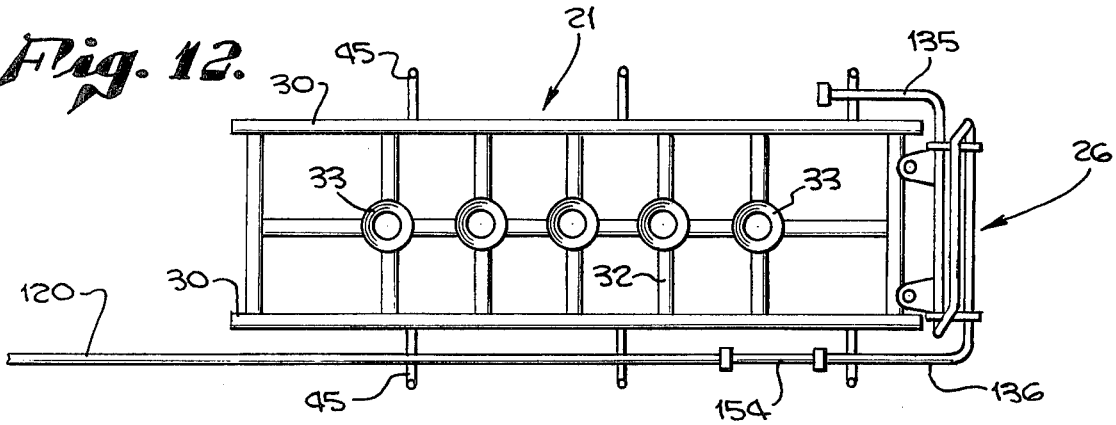
FIG. 12 is a schematic view showing the completed flowline-pipe loop connection.
Figure 19:
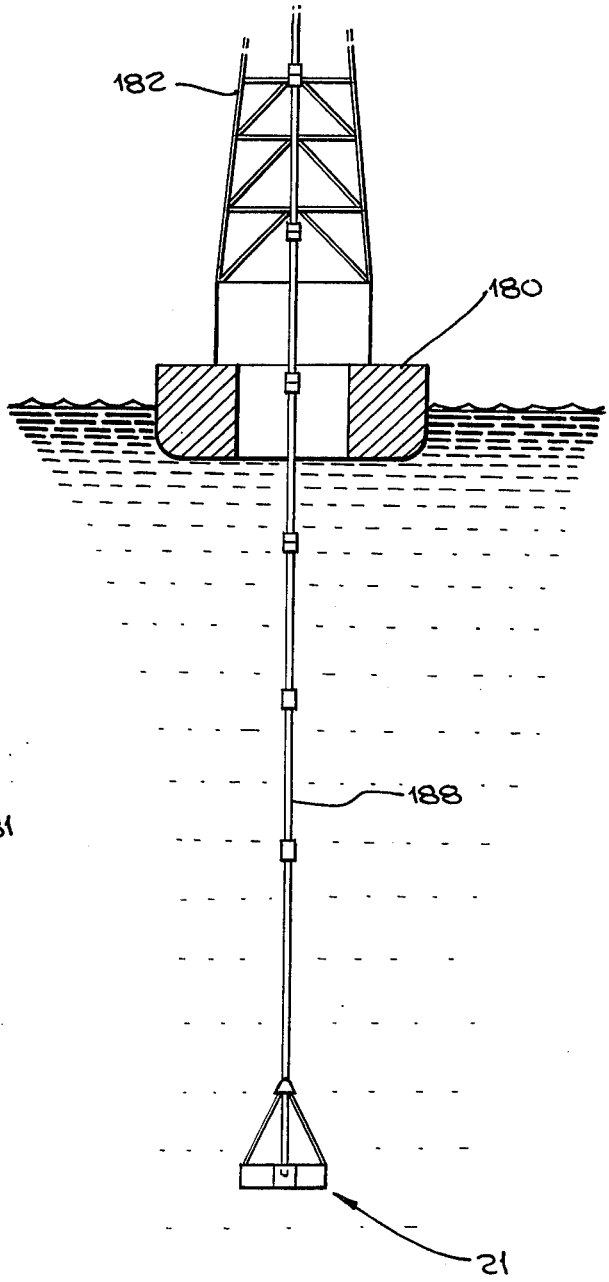
FIG. 19 is an end view of the drill ship with the rigid base means being lowered by drill pipe to the sea bottom.

Pipe loop means 26 also provides desired flexability and yieldability when making a connection to a subsea flowline which extends along the side of the rigid base means and partially beneath the side structure 25 for connecting the subsea installation to a remote station. When making such a connection between the pipe loop means 26 and such a flowline, the section 117 of the outboard top side member 100 may be moved by the hinge arms 118 to an upward position where opening 116 is open at the top for reception of a pipe connecting device schematically indicated at 152, FIG. 9. The connecting device 152 may be lowered and guided vertically through the opening 116 and over an extension of the seabed flowline. Connector 152 is equipped with a cutting member 153 which will then cut the flowline at a location near one end of opening 116. After cutting, the connector device 152 is adapted to lower a precut pipe section 154 which will span the distance between the cut end of the subsea flowline and the end of a pipe, such as 135 or 136, of the pipe loop 26. Upon lowering of the precut pipe into position; that is, coaxial alignment with the subsea flowline and pipe 136, the pipe connection device 152 couples the ends of the precut pipe to the cut flowline and to the pipe 136. It will be apparent that in the making of such a pipe connection that the sea floor flowline will not be readily longitudinally or axially displaced because of its length and possible partial burial in the sea floor. The end of pipe 136 of the pipe loop 26 is readily laterally yieldable in the slot 132 and the 90° bending of pipe 136 between slot 132 and its free end, pipe 136 is readily and conveniently longitudinally axially displaced to couple pipe 136 to precut pipe section 154.

Means 27 for connecting a fluid conducting line to the subsea installation 20 is illustrated at the end of the installation opposite from the pipe loop means 26. Fluid connecting means 27 is described and claimed in a copending application Ser. No. 759,030. In general, fluid connecting means 27 comprises a longitudinally extending funnel-like connector 155 having its axis horizontal and provided with a suitable connection 156 to end transverse member 32 of the base frame means 21. In this example, funnel 155 carries on top of its cylindrical portion a pulley block 157 to assist in guiding the end of a fluid connector 158 into the funnel. Connector 158 may be secured in the funnel by suitable means.

A releasable connector unit 159 provided with spaced guide tubes 160 may be vertically lowered onto guide posts 43 provided on the rigid base means 21. Connector unit 159 may include and carry adjacent its bottom a means 161 for connecting to the connector 158. The connecting means is made in a vertical mode. The connector 158 and its attached line 162 may provide hydraulic pressure actuating fluid or other pressure fluid through unit 159 to suitable pipes or hoses located on the side structures 25 and the rigid base means 21 for fluid connection to equipment carried thereby and by modular assemblies 23 and 24 for operation of such equipment. It will be understood that the longitudinally extending side structures provide convenient means for distribution of such fluid conducting hoses and pipes.

Spaced from fluid connecting means 27 at the same end of the installation may be provided an electrical power connector generally indicated at 28 and described and claimed in copending application Ser. No. 759,031. As described above, rigid base means 21 includes a pair of upstanding guide posts 44 at said end, said guide posts 44 being adapted to receive a power unit or module 28 which is provided with guide sockets 166 for reception of posts 44 in a vertical mode. Connected to the electrical power unit 28 may be a suitable cable 165, which may extend to a remote power source. The electrical control unit 28 may comprise any desired electrical equipment for providing AC or DC current and for distribution of such electrical power to the modules 23 and 24 by cables along the side structures 21 or along the rigid base means 21.

The subsea station or installation 20 described above and its construction includes many advantages. The base means 21 provides a permanent structure or foundation upon which various modules and units of different types of construction can be readily supported by installation and guidance in a substantially vertical mode. The modular assemblies 23 and 24 and other modular assemblies to occupy the receptor openings 22 may be readily guided by one or more guide lines to their operating position on the base frame means 21. The elongated side structures 25 are assembled with the base means 21 in a vertical mode and such side structures are positioned on the base means 21 so that they overhang the sides of the base means in order to provide protection to the permanent base means 21. The side structures 25 are adapted to provide a longitudinally extending upwardly facing channel or recess in which may be laid pressure fluid lines and electrical power lines, fluid conducting lines and other means which may be used for operation and control of equipment carried by the modular assemblies 23 and 24. The side structures 25 are so constructed and arranged that the top inboard and outboard rails thereof are supported for use as a track for a subsea vehicle or capsule which may readily move from one modular assembly to another or to equipment thereon or remote manipulation and service of such equipment.

An important advantage of the installation is the provision of precisely located, fixed or controlled connection points for equipment with the base means and with the module assemblies and particularly the points of connection of fluid conducting lines and power lines. Such connecting points are predetermined, built into the assembly arrangement of the base means, side structures, pipe loop means, and in the relation of the module assemblies to equipment associated therewith. Thus, initial installation assembly, maintenance, or workover operations by operators or by remote control are facilitated and enhanced.

It should also be noted that the support of flowlines alongside the rigid base means provides a protected and a convenient means for connecting such flowlines to the pipe loop means 26 at one end of the installation. The pipe loop means 26 provides communication to either or both sides of the subsea installation and provides means for carrying manifold fluid from various modular assemblies on the installation. In this example, if one side structure is removed, the other side structure supports control means sufficient to operate the modular assemblies. The valving and automatic connector arrangement on the pipe loop means permits isolating and operating from one side structure while the other is removed. It will be understood that the power control means for operating the modules includes a main power system and a back-up power system which will permit continuance of operation of several module assemblies during shut down of one or more module assemblies.

In the above description, a single subsea installation or station is shown. The invention contemplates that a plurality of such subsea stations may be installed on the sea bottom in any selected arrangement as, for example, in a line whereby five and more receptor openings 22 may be located above a linear arrangement of wells in several rows or columns, or by the arrangement of such stations in a polygonal arrangement having two, three or more stations arranged in any selected pattern depending upon the configuration and characteristics of the sea floor and the location and positioning of subsea wells.

Figure 13:
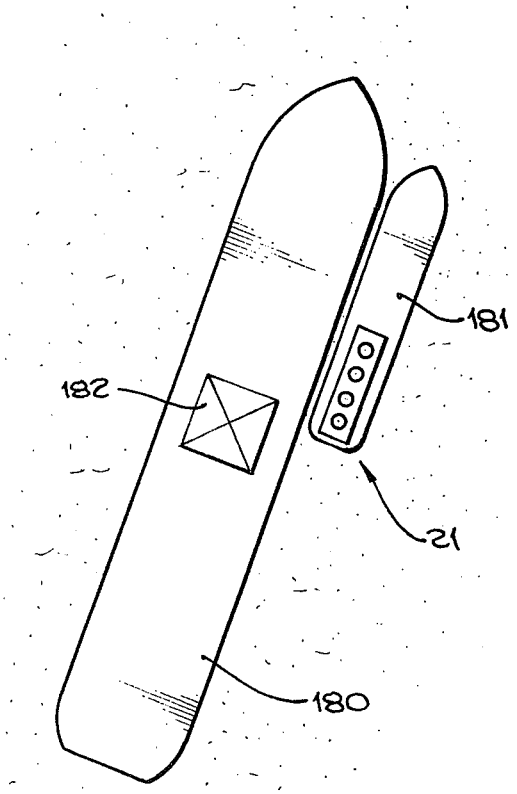
FIG. 13 is a top plan view of a drilling ship and a work boat carrying a rigid base template frame means thereon prior to lowering of the base frame means.
Figure 14:
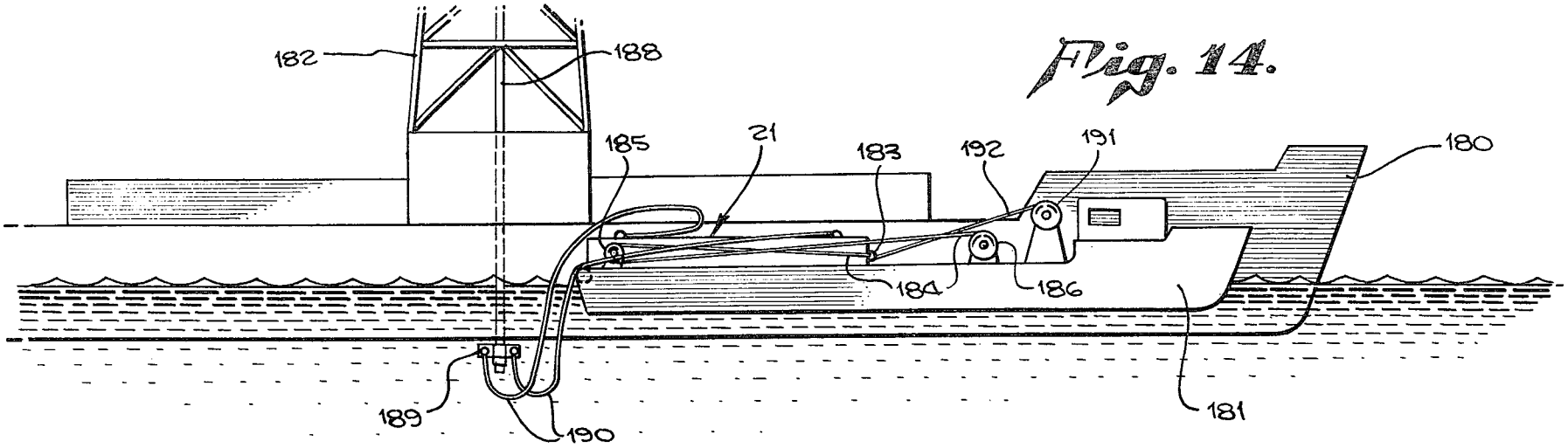
FIG. 14 is a side elevational view illustrating the connection of drill pipe to the frame means on the work boat and winch means for lowering the frame means over the stern of the work boat.

In FIGS. 13–19, there is shown a method of installing and lowering to the sea bottom a rigid base template means 21 as described above or other rigid elongated frame means. In FIG. 13, a drilling ship 180 is shown with a smaller work boat 181 laying alongside the forward portion of the ship and with the stern of the work boat lying approximately opposite a drilling rig 182. In FIGS. 14–17 are shown a sequence of steps for lowering the template 21 to the sea floor. In FIG. 14, template 21, at its forward end with respect to work boat 181, is provided with a connection 183 to a winch line 184. Winch 184 extends aft from connection 183 to a winch line 184. Winch 184 extends aft from connection 183 to sheave block 185 adjacent the stern of work boat 181. Winch line 184 extends around the sheave block and then extends forwardly to a first winch means 186. The arrangement of the winch line 184, sheave block 185, winch means 186 is provided on each side of the template 21.

The drilling rig 182 carries a supply of drill pipe, one section of which is indicated at 188; and the end of such drill pipe may be provided with a connection 189 to flexible cable 190 connected at their other ends to the template to provide a sling for the template 21.

Figure 15:
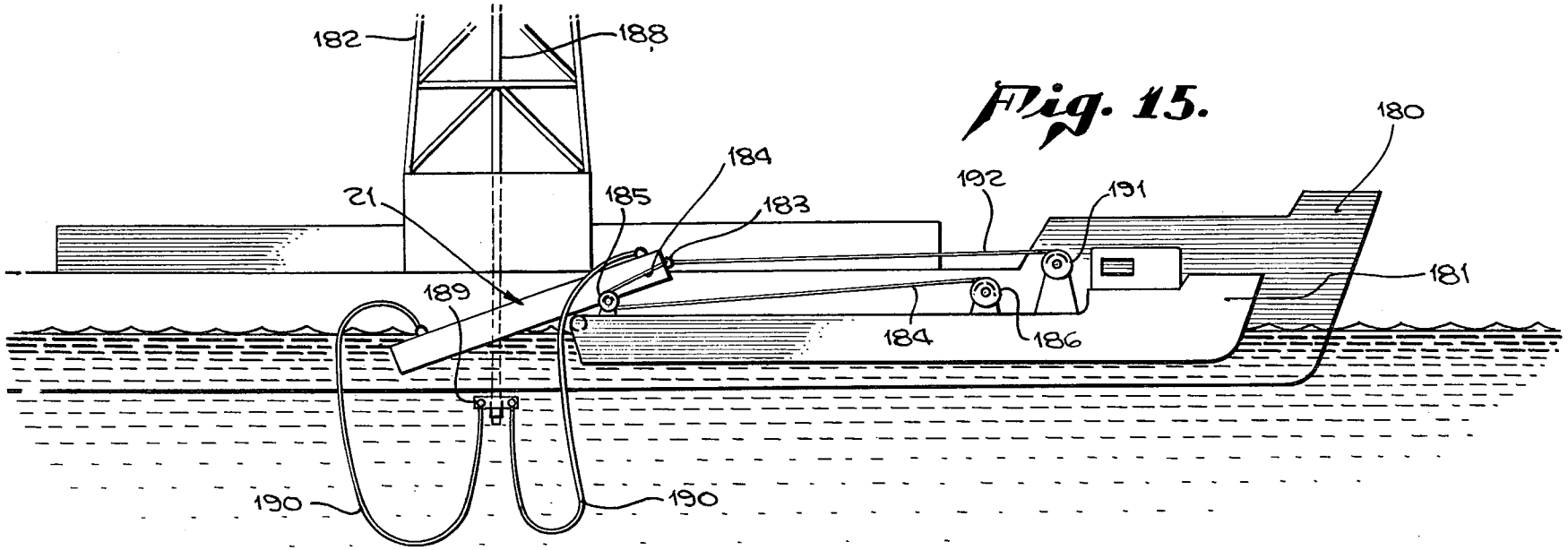
FIG. 15 is a view similar to FIG. 14 showing the rigid frame means tilted at an angle as it is moved over the stern of the work boat.

As the winch line 184 is drawn onto winch means 186, the winch line will pull the template 21 toward the stern of the work boat 181 and move the template 21 over the stern as shown in FIG. 15. It will be understood that the tubular construction of the template 21 permits suitable ballasting of the template, if required. For this purpose the tubular members of the template are provided with fluid intercommunication and suitable inlet and outlet valves for water and air.

As shown in FIG. 15, the winch means 186 pulls the template over the stern until it is partially in the water with the sling line 190 connected thereto. Such movement is controlled or restrained by second winch means 191 having a winch cable 192 connected to template 21 at 183.

Figure 16:
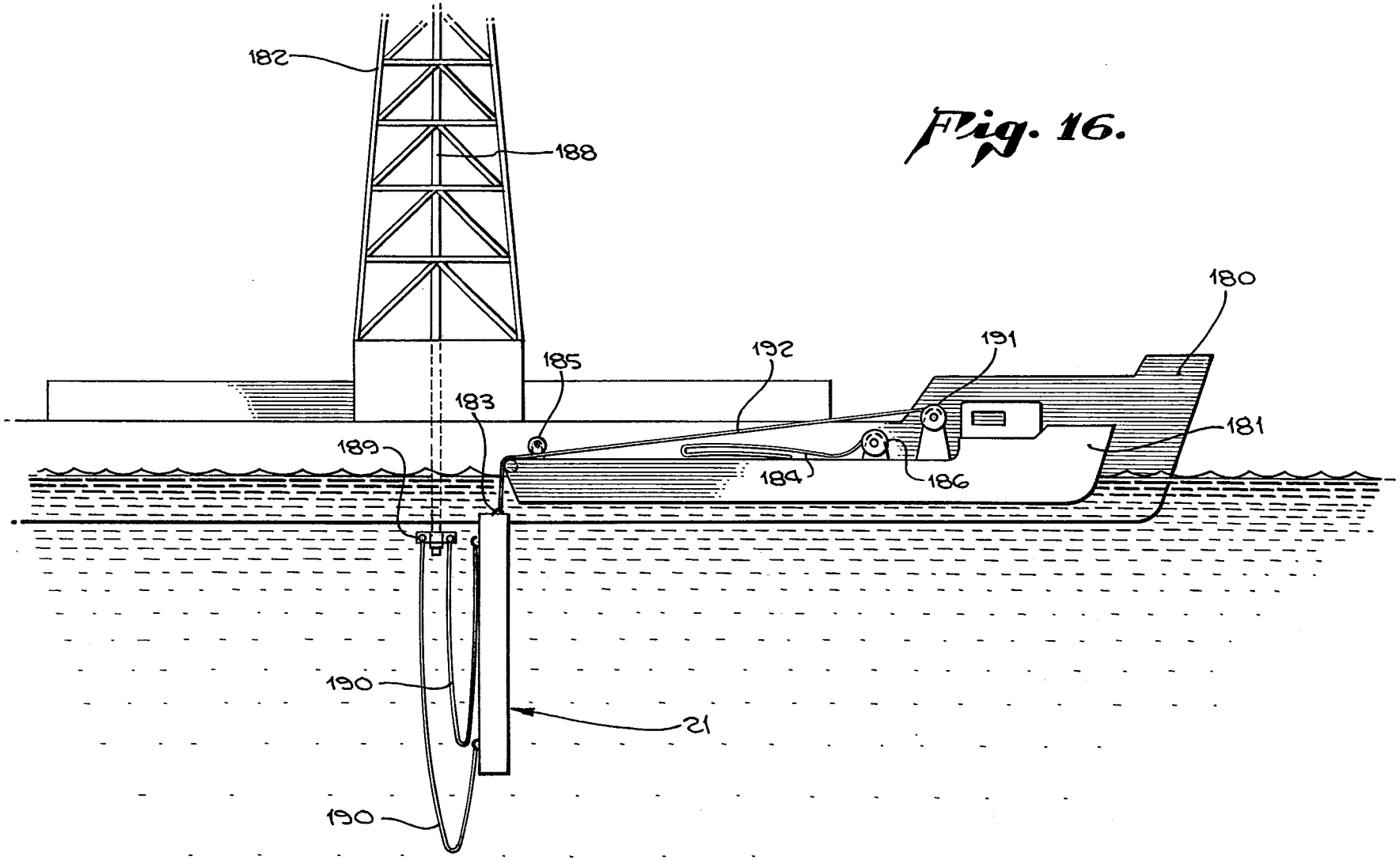
FIG. 16 is a view similar to FIGS. 14 and 15 showing the rigid frame means in vertical position off the stern of the work boat.
Figure 17:
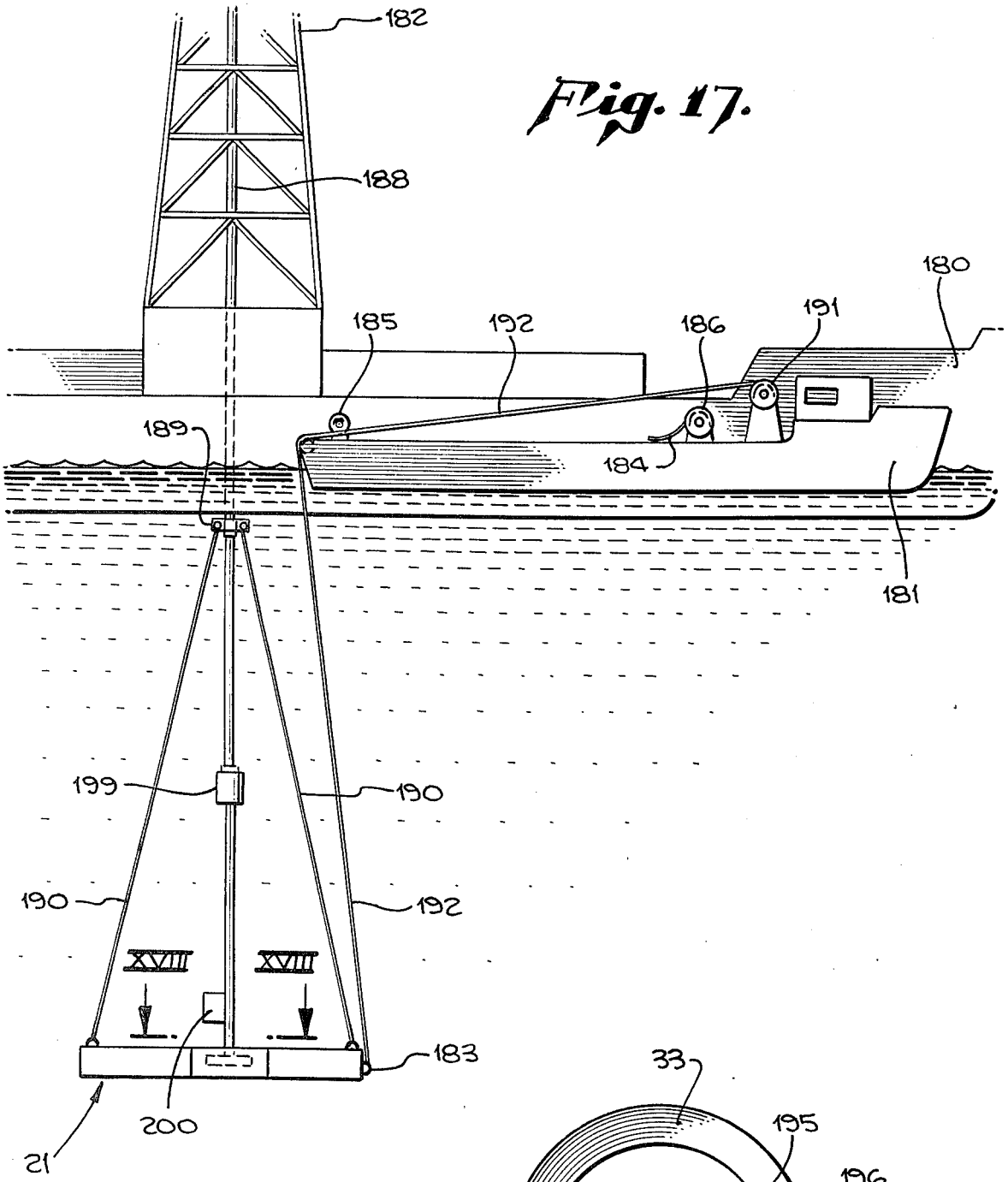
FIG. 17 is a view similar to FIGS. 14, 15 and 16 showing the rigid base means in a horizontal position and being lowered to the seabed.
Figure 18:
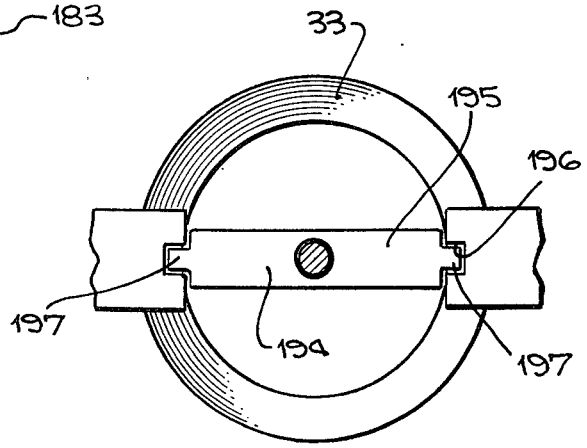
FIG. 18 is an enlarged, fragmentary view taken in the plane indicated by line XVIII — XVIII of FIG. 17 showing a means for controlling the angular orientation of the frame means.

In FIG. 16, the template is illustrated as hanging vertically in the water just beyond the stern of the work boat and with the sling lines connected thereto. In this vertical position of template 21, the second winch means may take all of the strain of the template load to permit the sheave lines 184 to be detached from template 21. From this vertical position of the template base means 21, the sling lines may be retracted so that the template 21 may lie horizontally below the surface of the water and below the opening in the drill ship through which the drill pipe and sling extend. While the template is fully supported from the drill pipe sling and drill ship, the restraint cable 192 may be released from its connection at 183 by suitable automatic means. In this position of the template below the drill pipe of the derrick, the drill pipe may be lowered and brought into engagement with and fixed to a keying member 194, which is received within an adaptor means 195 fixed to and carried by template 21 at the central conductor pipe 33. The adaptor means 195 includes vertically extending key slots 196 for reception of vertically extending key elements 197 on the keying member 194.

As the template 21 is lowered into the water, the drill pipe may be equipped with a suitable vertical slip joint means 199 to reduce and minimize motion transmitted from the drill ship to the template 21.

The template is then lowered to the sea bottom by the drill pipe and is held in horizontal position by the sling lines 190. As the template approaches the sea bottom, it is desirable that the longitudinal axis of the template be oriented in a certain position depending upon the configuration of the sea bottom and the direction from which the sea floor flowlines approach the subsea installation. The attitude or orientation of the template is sensed by an attitude control device 200 which transmits the position of the template to the drill ship. Angular or azimuth orientation of the base means may be controlled by the application of torque forces to the drill pipe through the rotary table on the drill ship in order to orient the template base means into a selected position on the seabed.

Modification and changes in the above description of a subsea station and method of installing the subsea station on the sea bottom may be made which come within the spirit of this invention and all such changes and modifications coming within the scope of the appended claims are embraced thereby.

We claim:

1. A subsea installation for assembly and use in virtually any depth of water by vertical installation of subsea components comprising, in combination:

an elongated rectangular rigid base frame means adapted to be permanently placed on a sea floor and having top and bottom parallel side members, said base frame means including transverse members providing a plurality of framed receptor openings with said side members, a conductor pipe centrally located in each opening, support members for said conductor pipe connected to said side and transverse members;

a base guide unit receivable in one of said receptor openings, coaxially aligned with said conductor pipe, and removably secured to said support members;

a removable, unitary module assembly vertically cooperable with said base guide unit for aligning and registering said module assembly with said one receptor opening in said base frame means;

said module assembly having well operable means adapted for connection to well components by relative vertical movement;

said side members and said transverse members at ends of said base frame means having vertically disposed guide means for connection by relative vertical movement to well operating components;

and control means supported from said base frame means for said module assembly and releasably interconnected with said module assembly.

2. In a subsea installation as stated in claim 1 wherein said unitary module assembly includes a top wall spaced above said base guide unit, said top wall including means for entrapment of lighter than water pollutants, and means beneath said top wall for detecting the presence of said pollutants.

3. An installation as stated in claim 1 wherein said base guide unit includes a guide post, a longitudinal slot in said guide post, and gate means for said slot adapted to releasably confine a guide line therein.

4. An installation as stated in claim 1 including an elongated removable side structure extending along and extending sidewardly beyond at least one side of said base frame means and releasably connected thereto, said elongated side structure carrying one or more lines for conducting fluid;

and means for connecting the fluid conducting lines on said elongated side structure to said module assembly.

5. A subsea installation as stated in claim 4 wherein at least one of said elongated side structures includes longitudinally extending outboard side rails having pivotally mounted side rail sections for movement to a depending position to facilitate maintenance and repair of flowlines alongside said base frame means.

6. An installation as claimed in claim 5 including means on said base frame means for supporting an end portion of a flowline laid on the sea bottom in a position adjacent said pivotally mounted side rail section for such maintenance and repair.

7. An installation as claimed in claim 4 wherein said elongated removable side structure includes parallel inboard and outboard members adapted to serve as guide rails for a subsea capsule;

said inboard member having releasable sections to provide openings for passage therethrough of a portion of a fluid line in a manner for vertical coupling of said fluid line to said module.

8. In a subsea installation as stated in claim 1 including an elongated side structure extending along and extending sidewardly beyond each side of the rigid base frame means and secured thereon, each elongated side structure having releasable connections to said module assembly for conducting fluid to and from said module assembly.

9. In a subsea installation as stated in claim 8 wherein each of said elongated side structures includes fluid conducting lines;

and transversely disposed pipe loop means releasably supported on said base frame means at one end thereof and having fluid interconnection with fluid lines on said elongated side structure and flowlines to stations remote therefrom.

10. In a subsea installation as stated in claim 8 including means on said rigid base frame means for supporting a flowline for connection to ends of said transversely disposed loop means.

11. In a subsea installation as stated in claim 1 wherein said unitary module assembly includes a module base cooperable with said base guide unit;

a top circular wall;

and a plurality of spaced, peripherally disposed columns interconnecting the module base and the module top wall adapted to protect equipment carried by said module assembly between said base and wall.

12. In an installation as stated in claim 11 including equipment means carried by said module beneath said top wall and within said columns whereby said equipment means is protected and shielded.

13. A subsea installation as stated in claim 1 wherein said unitary module assembly includes a circular top wall spaced above said base frame means;

and guidance means including edge means lying in the surface of a cone generated about the vertical axis of said module assembly and above said top wall for guiding a sea vehicle into aligned relationship with said module assembly.

14. A subsea installation as stated in claim 13 wherein said top wall includes a planar top circumferential surface for cooperation with a seal means on said sea vehicle.

15. A subsea installation adapted for vertical assembly in virtually any depth of water comprising in combination:

an elongated rectangular base frame means adapted to be permanently placed on a sea floor and having top and bottom parallel side members interconnected by longitudinally spaced transverse members for providing a plurality of polygonal receptor openings;

said side members and transverse members at the ends of said frame means having selectively spaced upstanding vertical guide posts;

an elongated side structure for each side of said frame means, each side structure having guide sockets cooperable with guide posts on said frame means, each side structure extending outboardly beyond the side members of said base frame means and adapted to protectively overlie a sea floor flowline portion laid alongside said frame means;

said spaced guide posts at one end of said frame means being adapted to be cooperable with pressure fluid means and electrical power means for connection thereof to said frame means;

fluid lines carried by said side structures;

a transversely disposed manifold means at the other end of said frame means having guide sockets cooperable with said guide posts at said end of the frame means and adapted to interconnect said fluid lines;

a base guide unit received in one of said receptor openings and removably secured to said frame means and having upstanding guide posts;

a removable unitary module assembly having guide sockets vertically cooperable with said guide posts on said guide unit for aligning and registering said module assembly in said receptor opening;

and means for releasably interconnecting said fluid pressure means and said electrical power means with said module assembly for control thereof.

16. An installation as claimed in claim 15 wherein said transverse manifold means includes a manifold frame means having guide sockets for vertical assembly with said guide posts at said other end of said frame means; said manifold means including a transverse loop of fluid conducting pipe supported from said manifold frame means and having end pipe portions extending along said side members of said frame means for connection to flowline laid alongside said base frame means.

* * * * *

UNITED STATES PATENT AND TRADEMARK OFFICE

CERTIFICATE OF CORRECTION

PATENT NO. : 4,120,362

DATED : October 17, 1978

INVENTOR(S) : Georges M. Chateau et al

It is certified that error appears in the above-identified patent and that said Letters Patent are hereby corrected as shown below:

Column 7, line 32, delete "housing" and insert -- housings --.
Column 12, lines 27 and 28, delete "Winch 184 extends aft from connection 183 to a winch line 184."; line 28, after "Winch" insert -- line --.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*